United States Patent [19]

Heller

[11] Patent Number: 4,575,397

[45] Date of Patent: Mar. 11, 1986

[54] RAIL HAVING HIGH RESISTANCE TO WEAR IN ITS HEAD AND HIGH RESISTANCE TO RUPTURE IN ITS FOOT

[75] Inventor: Wilhelm Heller, Duisburg, Fed. Rep. of Germany

[73] Assignee: Krupp Stahl Aktiengesellschaft, Bochum, Fed. Rep. of Germany

[21] Appl. No.: 656,400

[22] Filed: Oct. 1, 1984

[30] Foreign Application Priority Data

Oct. 4, 1983 [DE] Fed. Rep. of Germany ..... 3336006

[51] Int. Cl.[4] ..... C21D 9/04; C21D 1/18

[52] U.S. Cl. ..... 148/12 B; 148/12.4; 148/144; 148/148; 148/39

[58] Field of Search ..... 148/12 R, 12 B, 12.4, 148/36, 39, 134, 143, 144, 145, 148, 157; 266/113, 124, 125, 134

[56] References Cited

U.S. PATENT DOCUMENTS

| | | | |
|---|---|---|---|
| 1,285,749 | 11/1918 | Lewis | 148/36 |
| 1,418,985 | 6/1922 | Stock | 148/152 |
| 1,828,325 | 10/1931 | Kurz | 148/148 |
| 2,793,947 | 5/1957 | Swanson | 148/36 |
| 3,726,724 | 4/1973 | Davies et al. | 148/36 |
| 4,082,577 | 4/1978 | Heller | 148/36 |
| 4,486,248 | 12/1984 | Ackert et al. | 148/152 |

FOREIGN PATENT DOCUMENTS

| | | | |
|---|---|---|---|
| 1583418 | 5/1972 | Fed. Rep. of Germany | 148/157 |

OTHER PUBLICATIONS

Metals Abstracts, vol. 11, 1978, No. 31-3275, "Some Features and Metallurgical Considerations of Surface Defects in Rail due to Contact Fatigue," p. 2169.

*Primary Examiner*—Peter K. Skiff

*Attorney, Agent, or Firm*—Sprung Horn Kramer & Woods

[57] ABSTRACT

The invention relates to a rail having high resistance to wear in its head and high resistance to rupture in its foot. It is the characteristic feature of the invention that after rolling followed by heat treatment the rail has a fine pearlitic structure in the head and a martensitic annealed grain structure in the foot. The invention also includes preferred methods of heat treatment for the rail.

11 Claims, 1 Drawing Figure

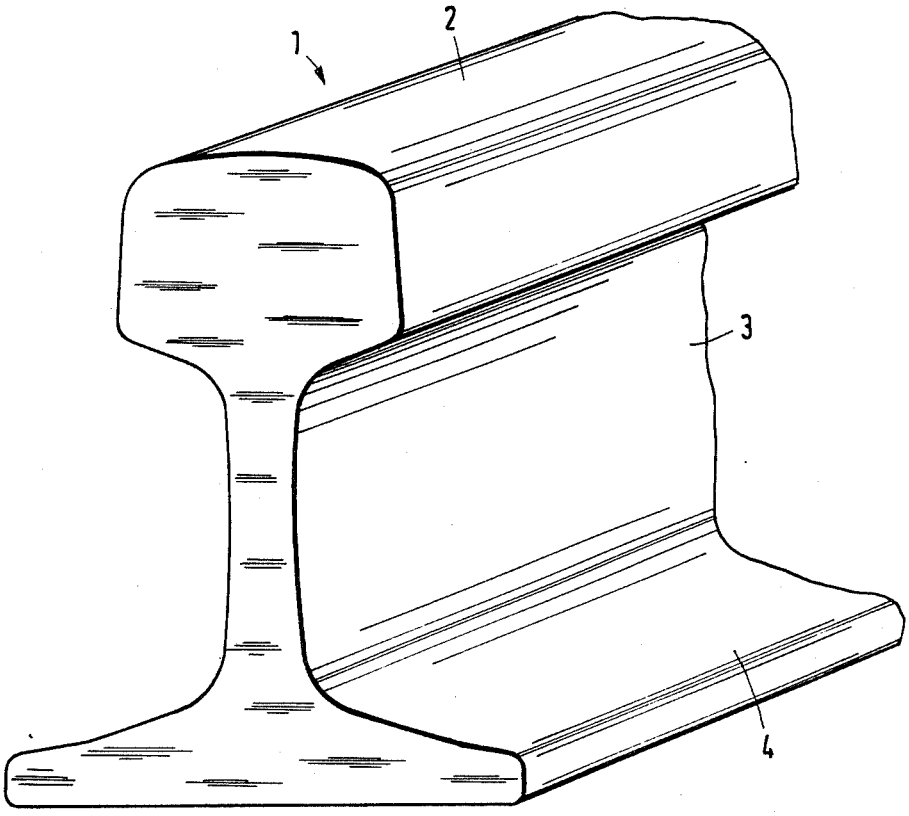
1
2
3
4

RAIL HAVING HIGH RESISTANCE TO WEAR IN ITS HEAD AND HIGH RESISTANCE TO RUPTURE IN ITS FOOT

BACKGROUND OF THE INVENTION

1. Field of the Invention

The invention relates to a rail having high resistance to wear in its head and high resistance to rupture in its foot.

2. Discussion of the Prior Art

Rails for rail vehicles should on the one hand have high resistance to wear in the head and on the other hand, because of the flexural tensile stress in the track, high resistance to rupture in the foot. As resistance to wear increases and resistance to rupture decreases with increasing strength of the rails, it has not hitherto been possible to improve both properties simultaneously in one material composition. A solution was seen in the so-called two-component rail, which through composite casting was composed of a high-strength material with high wear resistance in the rail head and of a soft material having good toughness properties in the web and foot of the rail. Because of the low strength in the rail web and foot, such rails, however, are not suitable for heavy stresses, since they undergo plastic deformation under heavy axle loads (22 tons). Moreover, in the region of the transition of the materials metallurgical disturbances cannot be avoided with adequate certainty. These may lead to fatigue fractures. Composite casting rails have, therefore, not been used for a long time.

In rails, which in their air-cooled naturally hard state have a pearlitic structure, other solutions seek either to increase strength in the rail head by subsequent heat treatment (as, for example, the German Journal "Stahl und Eisen" 90, 1970, No. 17, pp. 922–928) or to improve toughness in the rail foot by heat-treating the pearlitic structure of the rails in their state of natural hardness (Austrian Patent Specification No. 259,610). An optimum solution is also not achieved in this manner, since even with a heat-treated pearlitic structure in the rail foot only a light improvement of resistance to rupture can be achieved.

The resistance of rails to brittle fracture has hitherto been judged solely on the basis of the insensitivity of the rail steel to brittle fracture. Characteristic values in this respect are determined by tensile tests and rail impact tests. They are a measure of the deformability of steel before rupture. These tests are carried out as part of the acceptance trials for the rails. They have proved satisfactory in the judging of the rupture resistance of rails. In individual cases further information is obtained from notched bar impact bending tests in dependence on the test temperature. However, all these test methods permit only comparative grading of steels, while quantitative application of test results to the behavior of the component, that is to say in this particular case to the rail in the track, is not possible.

In order to be able to assess quantitatively the rupture resistance of rails, in recent times use has been made of crack resistance, determined as a characteristic value of the material in mechanical fracture investigations, to judge rupture behavior. Crack resistance is thereby determined in accordance with ASTM Standard E 399-74.

The crack resistance test is described in detail in DE-Z "Tech. Mitt. Krupp Werksberichte", vol. 39 (1981), No. 1, pp. 33–42.

From this publication, it can further be seen that rail steels having strengths above 900 N/mm$^2$ according to the prior art, for example, in accordance with UIC-Kodex 860 V, in the hard-rolled state or in the heat-treated pearlitic structure state usually have crack resistance values of 1000 to 2000 N/mm$^{3/2}$. In the hard-rolled state the tensile strength of standard rails is above 900 N/mm$^2$ and the yield point is above 450 N/mm$^2$. With heat treatment followed by cooling to a fine pearlitic structure in the head or over the entire cross-section of the rail, it is true that these values can be raised to 1100 N/mm$^2$ for tensile strength and to 600 N/mm$^2$ for the yield point, but crack resistance is scarcely changed. In general, it can be said that rail steels, which, based on analysis, have higher strength values, show poorer crack resistance values in the lower scatter range. This means that these rails show better wear behavior in the track, but have an increased tendency towards brittle fracture, particularly at high axle loads above 22 tons.

Taking this prior art as starting point, it is an object of the present invention to provide rails having an optimum combination of high strength in the head and high crack resistance in the foot, and which, in the track, and even with high axle loads above 22 tons, show good wear resistance in the head and such high resistance to rupture in the foot that plastic deformations and brittle fractures are avoided.

SUMMARY OF THE INVENTION

Broadly this invention contemplates a rail for a rail vehicle having a head and a foot interjoined by a web said rail having a high resistance to wear in its head and a high resistance to rupture in its foot, said rail produced in that after the same has been rolled it is subjected to a heat treatment to provide a fine pearlitic structure in its head and a martensitic annealed grain structure in the foot.

The rail according to the invention preferably has the following composition:

carbon: 0.6 to 0.82 weight percent
silicon: up to 0.5%
manganese: 0.70 to 1.70 weight percent
balanced iron with the usual impurities resulting from smelting.

Such a rail has a tensile strength above 1100 N/mm$^2$ in the head and a crack resistance value greater than 3000 N/mm$^{3/2}$ with tensile strengths of greater than 900 N/mm$^2$ in the foot.

It has been found that the martensitic annealed grain structure established in the foot of the rail is vital for high rupture resistance of the rail.

With such a structure and with tensile strength values in the head of greater than 1100 N/mm$^2$ and in the foot of greater than 900 N/mm$^2$, rails of the composition above have crack resistance values greater than 3000 N/mm$^{3/2}$.

Preferably, the rail of the invention has the following composition:

carbon: 0.65 to 0.82 weight percent
silicon: 0.10 to 1.20 weight percent
manganese: 0.70 to 1.50 weight percent
chromium: 0.40 to 1.30 weight percent
vanadium: up to 0.2% by weight
molybdenum: up to 0.15% by weight balance iron and the usual impurities resulting from smelting.

Such a rail has a tensile strength of over 1100 $N/mm^2$ in the head and crack resistance values of more than 2000 $N/mm^{3/2}$ with tensile strengths of over 1000 $N/mm^2$ in the foot.

It has been found that a composition of 0.60 to 0.82% carbon, up to 0.5% by weight silicon, 0.70 to 1.708% manganese with the balance iron and the usual impurities which does not have a martensitic annealed grain structure in the foot, has a crack resistance value of the order of only 1500 to 2000 $N/mm^{3/2}$. A rail having a composition of 0.65 to 0.82% carbon, 0.10 to 1.28 weight percent silicon, 0.70 to 1.50 weight percent manganese, 0.50 to 1.30 weight percent chromium, up to 0.2% vanadium, up to 0.15% molybdenum, balance iron has crack resistance values of the order of only 1000 to 1400 $N/mm^{3/2}$ when the foot does not have a martensitic annealed grain structure.

Rail steels of the characteristics described above have high strengths in the rail head which, of course, is equivalent to high wear resistance. The simultaneously high strength and good cracking resistance values in the foot of the rail render the rails of the invention suitable as rails undergoing high axle loads of above 22 tons, without plastic deformation of the rails occurring, while at the same time achieving high resistance to brittle fracture.

Rails according to the invention are provided in that after rolling and air cooling to room temperature the rail is austenitized at a temperature in the range of 810° to 890° C. and subjected to accelerated cooling, the rate of cooling in the head region being so selected, in conformity with the composition in the material in each case, that after cooling to room temperature a fine pearlitic structure is obtained, while maintaining a rate of cooling in the foot region such that, in conformity with the composition of the material in the particular case, a martensitic structure is obtained which is then heat treated at a temperature of 600° to 700° C.

Preferably, the rate of cooling is such that in the head region it is 15° to 50° C. per second from the austenitized temperature of 810° to 890° C. down to a temperature of 450° C. while the rate of cooling in the foot region is 5° to 60° C. per second down to a temperature of 100° C.

The austenitization is preferably carried out such that the rail is continuously heated to austenitization temperatures and continuously quenched by means of nozzles with compressed air or mixtures of compressed air or water or mixtures of compressed air and water vapor. The process can be conducted by quenching the rail from rolling heat.

The procedure described supra is especially useful for a rail having a composition as follows:

carbon: 0.60 to 0.82 weight percent
silicon: up to 0.5 weight percent
manganese: 0.70 to 1.708 weight percent
balance iron and the usual impurities resulting from smelting.

Rails having such analysis in the naturally hard state, that is to say in the air-cooled state after rolling, had a pearlitic structure with a strength above 900 $N/mm^2$. It is, therefore, necessary for both the head and foot of the rail to be suitably heat treated, so that a fine pearlitic structure is obtained in the head and a martensitic annealed grain structure is obtained in the foot.

When the rail has the following composition:

carbon: 0.65 to 0.82 weight percent
silicon: 0.10 to 1.20 weight percent
manganese: 0.70 to 1.50 weight percent
chromium: 0.40 to 1.30 weight percent
vanadium: up to 0.2% by weight
molybdenum: up to 0.15% by weight
balance iron and the usual impurities resulting from smelting.

It is treated somewhat differently than described supra. After the rail has been rolled and air-cooled to room temperature, the foot of the rail is continuously austenitized at a temperature of 810° to 890° C. and then continuously cooled at an accelerated rate of, on average, 5° to 60° C. per second by means of nozzles with mixtures of compressed air and water or of water and steam to a martensitic structure. Thereafter, it is heat treated at a temperature of 600° to 700° C. Rails made on such a procedure have, based on their analyses, a fine pearlitic structure in their naturally hard state after air cooling. For this reason, only heat treatment to form a martensitic annealed grain structure in the foot is necessary. On the final cooling of the rail, the fine pearlitic structure will automatically be obtained in the head of the rail because of the composition of the steel itself.

The heat treatment of the rails according to the invention can be advantageously carried out from rolling heat. With these rail steels the final rolling temperatures lie above the range of austenitization temperatures, that is to say between 800° to 900° C. It is thus unnecessary for the rails to be heated again to temperatures in the region of 810° to 890° C. after air-cooling to room temperature on the cooling bed. This procedure is to be recommended when suitable cooling devices are directly available, or can be installed, downstream of the roll stands in rolling mills.

The method parameter indicated in the method claims are to be understood as general conditions. Depending on the given analysis of the rail steels, they can be defined more precisely with the aid of the time-temperature-transformation curves known to the specialist, which show the cooling rates in °C./s for the respective structure states and analyses.

BRIEF DESCRIPTION OF DRAWING

The appended drawing is a perspective view of a rail according to the invention generally designated by reference 1 comprising a head 2, web 3 and foot 4.

In order to more fully illustrate the nature of the invention and the manner of practicing the same, the following examples are presented:

EXAMPLE 1

In the tests according to the invention a steel of the following composition in weight percent was used:

C—0.72
Si—0.35
Mn—1.28
Cr— —
V— —
P—0.022
S—0.018
Fe—remainder

The rail produced from this material was air-cooled after rolling, and in the rolled state had the mechanical properties listed in Table 1, column 1, below. After austenitization of the entire rail cross-section at 830° C., the head was cooled in 15 seconds with compressed air to 450° C. on the surface. The foot of the rail was cooled with a mixture of compressed air and water in 20 seconds to room temperature. The foot of the rail was then heat-treated at 650° C. Through the heat treatment a fine pearlitic structure was obtained in the head of the rail to a depth of 20 mm from the surface, and a martensitic annealed grain structure was obtained in the rail foot with the exception of a limited zone below the web. The mechanical properties after the heat treatment are shown in Table 1, column 3, for the rail head, and in Table 1, column 4, for the rail foot. The tensile strength in the rail head had increased by 180 N/mm$^2$ to 1150 N/mm$^2$. Wear resistance had roughly doubled. Elongation at break and crack resistance had varied only insignificantly in the rail head. Through the annealing of the rail foot, the yield point rose in approximately the same way as in the rail head. In this way, the loadability of the rails was increased, even for high axle loads of up to 35 tons. The crack resistance was more than doubled by the annealing.

TABLE 1

Mechanical properties of rails according to Example 1:

| | Rolled state | Heat-treated | |
|---|---|---|---|
| | Head/foot | Head | Foot |
| $R_{p0.2}$ = yield point N/mm$^2$ | 510 | 810 | 830 |
| $R_m$ = tensile strength N/mm$^2$ | 970 | 1150 | 980 |
| $A_5$ = elongation at break % | 12.5 | 12.8 | 22 |
| $K_{Ic}$ = crack resistance N/mm$^{3/2}$ | 1300 | 1400 | 3100 |

Whereas with a customary internal tensile stress at the lower face of the rail foot of about 240 N/mm$^2$ and an additional flexural tensile stress through traffic loads of 200 N/mm$^2$ the rail, in the rolled state, will tolerate surface defects only up to a depth of 3 mm before it undergoes brittle fracture, the tolerable depth of defects is increased to over 25 mm through the improved crack resistance in the rail foot. Defects or damage of that depth occur only extremely rarely and can, moreover, be easily detected in good time by the usual non-destructive tests on the track. The rupture resistance of the novel rails has thus been substantially improved in comparison with conventional high-strength rails.

EXAMPLE 2

A material of modified composition, having the following composition in weight percent:

C—0.77
Si—0.80
Mn—1.05
Cr—0.98
V—0.011
S—0.023
Fe—remainder already has high strength in the rolled state because of its chemical composition.

The rail was, therefore, not subjected to further heat treatment. The rail foot was austenitized at 860° C. and then quenched to 100° C. in 120 seconds with a mixture of compressed air and water. The heat treatment temperature was 680° C. Through the annealing, a martensitic annealed grain structure was obtained in the entire foot cross-section. The mechanical properties measured on the rail are shown in Table 2.

TABLE 2

Mechanical properties of rails according to Example 2:

| | Rolled state | Heat-treated | |
|---|---|---|---|
| | Head/foot | Head | Foot |
| $R_{p0.2}$ = yield point N/mm$^2$ | 720 | 720 | 960 |
| $R_m$ = tensile strength N/mm$^2$ | 1210 | 1210 | 1100 |
| $A_5$ = elongation at break % | 9.8 | 9.8 | 19 |
| $K_{Ic}$ = crack resistance N/mm$^{3/2}$ | 1100 | 1100 | 2500 |

The high strength of the rail head imparts high resistance to wear to the rail. In conjunction with its good mechanical properties, particularly the high yield point in the foot of the rail, the rail is particularly suitable for use for heavy-load traffic with high axle loads (about 35 tons). Under the stress conditions mentioned in Example 1 (internal tensile stress through traffic loads), the tolerable crack depth of about 2 mm in the rolled state is increased to about 20 mm after the heat treatment of the rail foot. In this rail, also, the resistance to rupture is thus considerably improved.

Through methodical adjustment of the chemical composition and of the heat treatment of the rail foot or of the rail head and the rail foot, one can provide large number of combinations of different mechanical properties in the rail head and rail foot, and thus be free to adjust optimum combinations of wear resistance and rupture resistance in accordance with given requirements. At the same time, other chemical compositions than those given in the columns above are also possible. The chemical compositions given in the composition of Example 1 and 2 relate to rail steels customarily used at the present time.

In the case of rail materials which because of their analysis are liable to stress cracks if subjected to abrupt quenching, it is advisable to use cooling media which reduce liability to stress cracks, such as, for example, oil.

What is claimed is:

1. In a rail for a rail vehicle comprising a head and a foot interjoined by a web, the improvement wherein said rail is one having a fine pearlitic structure in its head to at least a depth of 20 mm from the surface and a martensitic annealed grain structure throughout its entire foot.

2. A rail according to claim 1 having the following composition:

carbon: 0.60 to 0.82 weight percent
silicon: up to 0.5 weight percent
manganese: 0.70 to 1.70 weight percent
balance iron with usual impurities resulting from smelting, said rail having a tensile strength above 1100 N/mm$^2$ in the head and a crack resistance value of greater than 3000 N/mm$^{3/2}$ with a tensile strength of greater than 900 N/mm$^2$ in the foot.

3. A rail according to claim 1 having the following composition:

carbon: 0.65 to 0.82 weight percent
silicon: 0.1 to 1.20 weight percent
manganese: 0.70 to 1.50 weight percent
chromium: 0.40 to 1.30 weight percent
vanadium: up to 0.2% by weight
molybdenum: up to 0.15% by weight
balance iron with usual impurities resulting from smelting, said rail having a tensile strength of over 1100 N/mm$^2$ in the head and a crack resistance value greater than 2000 $N/mm^{2/3}$ with a tensile of over 1000 $N/mm^2$ in the foot.

4. A method for producing a rail for a rail vehicle and having a head and a foot interjoined by a web, which comprises the steps of: subjecting a rail which has been rolled and air-cooled to room temperature to a temperature from 810° to 890° C. to austenized the same and thereafter cooling the same such that the rate of cooling in the head region is such to impart a fine pearlitic structure to such head region to at least to a depth of 20 mm from the surface after the same has been cooled to room temperature, the rate of cooling in the foot region being selected such that the resultant foot has a martensitic structure throughout after being cooled and thereafter heat treating said foot at a temperature of 600° to 700° C.

5. A method according to claim 4 wherein the head region of said rail is cooled at a mean rate of cooling of 15° to 50° C. per second down to a temperature of 450° C. and the foot is cooled at a rate of 5° to 60° C. per second down to a temperature of 100° C.

6. A method according to claim 4 wherein the rail is continuously heated at a temperature of 810° to 890° C. to austenitize the same and then is continuously quenched by applying compressed air or mixtures of compressed air and water or mixtures of compressed air and water vapor thereto through a nozzle.

7. A method of producing a rail for a rail vehicle and having a head and a foot interjoined by a web, which comprises the steps of: subjecting a rolled rail which has been air-cooled to room temperature to impart a fine pearlitic structure to the head region to at least a depth of 20 mm from the surface to heating to a temperature of 810° to 890° C. in the foot of the rail and thereafter continuously cooling the same at a mean rate of cooling of 5° to 60° C. per second by applying thereto a mixture of compressed air and water or a mixture of water and steam via nozzles whereby to impart to said foot a martensitic structure throughout and, thereafter, heating said foot at a temperature of 600° to 700° C.

8. A method of producing a rail for a rail vehicle and having a pearlitic head and a martensitic foot interjoined by a web, which comprises the steps of rolling a rail at a rolling heat and, thereafter, cooling the foot portion of such rail at a rate of 5° to 60° C. per second by applying a mixture of compressed air and water or a mixture of water and steam via nozzles whereby to form a martensitic structure throughout until such rail has reached room temperature.

9. A method according to claim 4 wherein said rail has the following composition:

carbon: 0.60 to 0.82 weight percent
silicon: up to 0.5 weight percent
manganese: 0.70 to 1.70 weight percent
balance iron with usual impurities resulting from smelting.

10. A method according to claim 7 wherein said rail has the following composition:

carbon: 0.65 to 0.82 weight percent
silicon: 0.1 to 1.20 weight percent
manganese: 0.70 to 1.50 weight percent
chromium: 0.40 to 1.30 weight percent
vanadium: up to 0.2% by weight
molybdenum: up to 0.15% by weight
balance iron with usual impurities resulting from smelting.

11. A method according to claim 8 wherein said rail has the following composition:

carbon: 0.65 to 0.82 weight percent
silicon: 0.1 to 1.20 weight percent
manganese: 0.70 to 1.50 weight percent
chromium: 0.40 to 1.30 weight percent
vanadium: up to 0.2% by weight
molybdenum: up to 0.15% by weight
balance iron with usual impurities resulting from smelting.

* * * * *